US005994472A

United States Patent [19]

Egashira et al.

[11] Patent Number: 5,994,472

[45] Date of Patent: Nov. 30, 1999

[54] IONOMER COVERED GOLF BALL

[75] Inventors: Yoshinori Egashira; Yasushi Ichikawa; Shunichi Kashiwagi, all of Chichibu, Japan

[73] Assignee: Bridgestone Sports Co., Ltd., Tokyo, Japan

[21] Appl. No.: 08/969,546

[22] Filed: Nov. 13, 1997

Related U.S. Application Data

[63] Continuation-in-part of application No. 08/689,829, Aug. 14, 1996, abandoned.

[30] Foreign Application Priority Data

Aug. 25, 1995 [JP] Japan ..... 7-240801

[51] Int. Cl.[6] ..... A63B 37/12

[52] U.S. Cl. ..... 525/221; 525/196; 525/201; 473/378; 473/385

[58] Field of Search ..... 525/196, 201, 525/221; 473/378, 385

[56] References Cited

U.S. PATENT DOCUMENTS 5,120,791 6/1992 Sullivan .
5,415,937 5/1995 Cadorniga et al. .
5,688,869 11/1997 Sullivan ..... 525/196

FOREIGN PATENT DOCUMENTS 6-313075 11/1994 Japan .
2 286 594 8/1995 United Kingdom .
WO 95/00212 1/1995 WIPO .

*Primary Examiner*—David Puttner
*Attorney, Agent, or Firm*—Sughrue, Mion, Zinn Macpeak & Seas, PLLC

[57] ABSTRACT

In a golf ball comprising a core and a cover, the cover is mainly composed of a resin consisting of a first ionomer in the form of a sodium neutralized ethylene/methacrylic acid/acrylate terpolymer having a flexural modulus of 1,000 to 15,000 psi and a second ionomer in the form of a magnesium neutralized ethylene/methacrylic acid copolymer having a flexural modulus of 20,000 to 48,000 psi. The blend has a Shore C hardness of 65 to 77. The ball has a soft feel, satisfactory spin rate, improved scuff resistance upon iron shots, and durability against top hitting with an excellent compatibility in cover.

18 Claims, No Drawings

IONOMER COVERED GOLF BALL

CROSS REFERENCE TO RELATED APPLICATION

This application is a continuation-in-part of application Ser. No. 08/689,829 filed on Aug. 14, 1996 now abandoned the entire contents of which are hereby incorporated by reference.

TECHNICAL FIELD

This invention relates to a golf ball comprising a core and an ionomer cover.

BACKGROUND

As the cover stock of two-piece golf balls and some wound golf balls, ionomer resins in the form of ethylene-(meth)acrylic acid copolymers have been widely used and accepted because of their long-lasting impact resistance and cut resistance. Since the ionomer resins provide hard hitting feel and high hardness as compared with the balata rubber conventionally used as the cover stock, ionomer covered golf balls are said difficult to impart a desired quantity of spin and inferior to control on iron shots.

For improvements in these respects, Sullivan, U.S. Pat. No. 4,884,814 or JP-A 308577/1989 proposes to blend a hard ionomer resin in the form of a zinc or sodium salt of an ethylene/(meth)acrylic acid copolymer having a certain spectrum of physical properties with a specific amount of a soft ionomer resin in the form of a zinc or sodium salt of an ethylene/(meth)acrylic acid/(meth)acrylate terpolymer. The soft/hard ionomer blend is used as a golf ball cover. This is a quite effective technique for improving the hitting feel and control of golf balls using a conventional ionomer resin in the form of an ethylene-(meth)acrylic acid copolymer as the cover.

Nevertheless, the golf ball cover made of the above-mentioned blend of soft and hard ionomers of zinc or sodium salt type has several problems. Despite improvements in hitting feel and control, the cover is softer and allows the ball to receive more spin on iron shots, which means the increased frictional force between the club face and the cover. There is a likelihood that the ball surface be marred or fluffed as a consequence of iron shots because the cover surface can be scraped by grooves across the iron club face.

Due to the reduced hardness, the ionomer cover itself is reduced in restitution, resulting in a ball with a substantial loss of restitution.

SUMMARY OF THE INVENTION

An object of the invention is to provide a novel and improved golf ball which has an excellent compatibility in a cover and is improved in feel, spin receptivity, control, scuff resistance upon iron shots, restitution, and durability.

Regarding a golf ball comprising a core and a cover, we have found that when the cover is mainly formed from a blend of an ionomer in the form of a sodium neutralized ethylene/methacrylic acid/acrylate terpolymer and another ionomer in the form of a magnesium neutralized ethylene/methacrylic acid copolymer, the blend having a Shore C hardness of 65 to 77, quite unexpectedly, there is obtained a golf ball which has an excellent compatibility in a cover, a soft hitting feel and improved in spin, restitution and durability while it receives less surface damages upon iron shots.

More particularly, by blending a first ionomer in the form of a sodium neutralized soft ethylene/methacrylic acid/acrylate terpolymer with a second ionomer in the form of a magnesium neutralized hard ethylene/methacrylic acid copolymer, preferably in a weight ratio of 20 to 90% by weight of the first ionomer to 80 to 10% by weight of the second ionomer, there is obtained a blend which takes advantage of compatibility and has an appropriate hardness of 65 to 77 on Shore C scale. While maintaining the improved properties of ionomer resins including durability against top hitting and cut resistance, the blend is successful in overcoming the problems of ionomer resins that the hitting feel is hard and controllability is poor as compared with the balata rubber. A cover made of this blend is soft enough to prevent the ball surface from being scuffed upon iron shots. There is obtained an optimum cover stock possessing the advantages of both the ionomer resin and the balata rubber.

The present invention provides s golf ball comprising a core and a cover, said cover mainly composed of a resin consisting of a first ionomer in the form of a sodium neutralized ethylene/methacrylic acid/acrylate terpolymer having a flexural modulus of 1,000 to 15,000 psi and a second ionomer in the form of a magnesium neutralized ethylene/methacrylic acid copolymer having a flexural modulus of 20,000 to 48,000 psi, said cover having a Shore C hardness of 65 to 77.

BEST MODE FOR CARRYING OUT THE INVENTION

According to the present invention, the cover of the golf ball is composed mainly of a blend of (A) a first ionomer in the form of a sodium neutralized ethylene/methacrylic acid/acrylate terpolymer and (B) a second ionomer in the form of a magnesium neutralized ethylene/methacrylic acid copolymer.

Component (A) or first ionomer is a sodium neutralized terpolymer of ethylene, methacrylic acid, and an acrylate. The acrylate used herein includes esters having about 4 to about 12 carbon atoms, for example, methyl acrylate, ethyl acrylate, isobutyl acrylate, n-butyl acrylate, and 2-ethylhexyl acrylate. Isobutyl acrylate is most preferred.

Preferably the content of methacrylic acid is 5 to 15% by weight, especially 7 to 12% by weight of the overall weight of component (A) and the content of acrylate is 5 to 45% by weight, especially 8 to 30% by weight of the overall weight of component (A). A methacrylic acid content of less than 5% by weight would lead to a loss of restitution whereas flexibility would be lost with a methacrylic acid content of more than 15% by weight. An acrylate content of less than 5% by weight would fail to provide a fully flexible composition whereas an acrylate content of more than 45% by weight would provide a composition which is too flexible and less cut resistant.

The methacrylic acid of the copolymer is neutralized with sodium ion to form an ionomer resin. The degree of neutralization is preferably 10 to 90 mol %, more preferably 30 to 80 mol %. Restitution would be insufficient with a degree of neutralization of less than 10 mol % whereas a degree of neutralization of more than 90 mol % would adversely affect flow during molding.

The first ionomer resin should preferably have a flexural rigidity of 10 to 100 MPa, especially 20 to 90 MPa. Cut resistance would be poor with a flexural rigidity of less than 10 MPa whereas an ionomer having a flexural rigidity of more than 100 MPa, when blended, would fail to provide a fully flexible cover stock, eventually failing to provide a soft feel. The first ionomer resin should preferably have a flexural modulus of 1,000 to 15,000 psi, especially 2,000 to 15,000 psi.

Component (B) or second ionomer is a magnesium neutralized copolymer of ethylene and methacrylic acid. Preferably the content of methacrylic acid is 10 to 20% by weight, especially 12 to 20% by weight of the overall weight of component (B). A methacrylic acid content of less than 10% by weight would lead to a loss of restitution whereas an ionomer with a methacrylic acid content of more than 20% by weight would lose flexibility, failing to provide a cover stock capable of affording a soft feel.

The copolymer is neutralized with magnesium ion to form an ionomer resin. The degree of neutralization is preferably 10 to 70 mol %, more preferably 15 to 60 mol %. Restitution would be insufficient with a degree of neutralization of less than 10 mol % whereas a degree of neutralization of more than 70 mol % would adversely affect flow during molding and increase moisture absorption.

The second ionomer resin should preferably have a flexural rigidity of 200 to 300 MPa, especially 220 to 280 MPa. An ionomer having a flexural rigidity of less than 200 MPa, when blended, would provide a less restitution cover stock whereas an ionomer having a flexural rigidity of more than 300 MPa, when blended, would fail to provide a fully flexible cover stock. The second ionomer resin should preferably have a flexural modulus of 20,000 to 48,000 psi, especially 30,000 to 45,000 psi.

In one preferred embodiment of the invention, the golf ball cover is mainly formed from a blend of 20 to 90%, especially 30 to 70% by weight of ionomer resin (A) and 80 to 10%, especially 70 to 30% by weight of ionomer resin (B). A blend of the two ionomer resins in a mix ratio outside the range would not maintain an appropriate hardness, failing to achieve the benefits of the invention.

The cover should have a Shore C hardness of 65 to 77, preferably 65 to 76, more preferably 65 to 75, most preferably 67 to 73. Restitution would be low with a Shore C hardness of less than 65 whereas no improvements in hitting feel and control are made with a Shore C hardness of more than 77.

Any desired ionomer resins may be used as components (A) and (B) insofar as they meet the above-mentioned requirements including flexural rigidity, flexural modulus and Shore C hardness. A mixture of ionomer resins may be used for each of components (A) and (B).

These ionomer resins are commercially available under the trade name of Surlyn from E. I. dupont, and Himilan from DuPont-Mitsui Polychemicals Co., Ltd. More specifically, ionomer resins belonging to component (A) are shown in Table 1 while ionomer resins belonging to component (B) are shown in Table 2. Other than the ionomer resins belonging to component (B), commonly known ionomer resins in the form of zinc or sodium neutralized ethylene/(meth)acrylic acid copolymers are shown in Table 3.

TABLE 1

| | Metal ion | Flexural modulus (psi) | Flexural rigidity (MPa) | Shore D hardness |
|---|---|---|---|---|
| Surlyn 8120 | Na | 7100 | 55 | 45 |
| Surlyn 8320 | Na | 2800 | 30 | 37 |

TABLE 2

| | Metal ion | Flexural modulus (psi) | Flexural rigidity (MPa) | Shore D hardness |
|---|---|---|---|---|
| Himilan AM 7311 | Mg | 35400 | 256 | 63 |

TABLE 3

| | Metal ion | Flexural modulus (psi) | Flexural rigidity (MPa) | Shore D hardness |
|---|---|---|---|---|
| Himilan 1706 | Zn | 48000 | 244 | 62 |
| Himilan 1605 | Na | 51000 | 280 | 62 |
| Surlyn 9320 | Zn | 2000 | 25.3 | 37 |

The golf ball cover of the invention is made of a cover stock mainly composed of a resin consisting of ionomer resins (A) and (B) as mentioned above while the cover stock may further contain various additives, for example, dyes, pigments (e.g., titanium dioxide, zinc oxide, and barium sulfate), UV absorbers, antioxidants, and dispersing aids (e.g., metal soaps). These ingredients are mixed in conventional mixers, for example, closed kneading machines (e.g., Banbury mixer and kneader), single and twin screw extruders and the resulting cover stock is molded by conventional procedures.

The golf ball cover of the invention is useful for solid golf balls and thread wound golf balls, especially solid golf balls such as two and three-piece solid golf balls.

In the case of solid golf balls, the solid core is preferably formed of a composition comprising a base rubber, a metal salt of an unsaturated carboxylic acid, a peroxide, and pentachlorothiophenol or a metal salt thereof. The preferred base rubber used herein is cis-1,4-polybutadiene rubber having at least 90% of a cis structure because of high restitution. The cis-1,4-polybutadiene rubber may be optionally blended with a suitable amount of natural rubber and polyisoprene rubber although the base rubber should preferably contain at least 80% by weight of high cis-1,4-polybutadiene rubber. If the content of cis-1,4-polybutadiene rubber is less than 80% by weight, the base rubber would not take full advantage of the high restitution of cis-1,4-polybutadiene rubber. The metal salt of an unsaturated carboxylic acid is blended as a co-crosslinking agent, preferably in an amount of about 25 to 40 parts by weight per 100 parts by weight of the base rubber. A typical salt is zinc acrylate. Exemplary peroxides are dicumyl peroxide, t-butylperoxybenzoate, di-t-butylperoxide, and 1,1-bis(t-butylperoxy)-3,3,5-trimethylcyclohexane. The peroxide is preferably blended in an amount of about 0.5 to 3 parts, especially about 0.8 to 2 parts by weight per 100 parts by weight of the base rubber. Pentachlorothiophenol or a metal salt thereof is blended in an amount of about 0.1 to 2.0 parts by weight per 100 parts by weight of the base rubber in order that the core composition exert definitely high restitution. Excessive blending of pentachlorothiophenol would restrain crosslinking reaction of the core composition.

In the core composition, there may be blended components conventionally used in the core of two-piece solid golf balls such as zinc oxide, antioxidant and barium sulfate, if desired. The core composition is kneaded in a Banbury mixer or kneader and molded and cured into a spherical core by hot pressure vulcanization in a conventional manner. In the practice of the invention, the core as cured preferably has a sufficient hardness to yield a distortion of 2.0 to 4.0 mm, especially 2.3 to 3.3 mm when a load of 100 kg is applied to the core. With a core distortion of less than 2.0 mm, a ball obtained by enclosing the core with a cover would be hard and give an unpleasant feel on hitting. A core distortion of more than 4.0 mm would lead to low restitution.

In the practice of the invention, a golf ball may be prepared by a conventional molding technique, for example, by molding a cover stock of the above-defined composition around a core. This molding may be accomplished by previously molding half cups from the cover stock, interposing a core between the half cups and effecting heat compression molding or by directly enclosing a core with the cover stock by injection molding. The injection molding process is selected for solid cores. For wound cores, the compression molding process allowing for molding at relatively low temperature is preferred from the standpoint of the heat resistance of thread rubber.

In the golf ball of the present invention, the cover preferably has a gage (or radial thickness) of 1.0 to 2.5 mm, more preferably 1.2 to 2.1 mm. A cover with a gage of less than 1.0 mm would lack cut resistance whereas a cover with a gage of more than 2.5 mm would result in a golf ball having short restitution.

With respect to hardness, the golf ball of the invention should preferably have a distortion of 2.0 to 4.2 mm, especially 2.2 to 3.2 mm under a load of 100 kg.

Like conventional golf balls, the golf ball of the invention is formed with a multiplicity of dimples in the cover surface. The geometrical arrangement of dimples may be octahedral, icosahedral or the like while the dimple pattern may be selected from square, hexagon, pentagon, and triangle patterns. After molding, the cover surface is subject to a series of finishing steps including buffing, painting and stamping.

It is understood that the golf ball of the above mentioned construction should have a diameter of not less than 42.67 mm and a weight of not greater than 45.93 grams in accordance with the Rules of Golf.

EXAMPLE

Examples of the present invention are given below by way of illustration and not by way of limitation. All parts are by weight.

Examples and Comparative Examples

For the manufacture of two-piece golf halls, a solid core was prepared from a rubber composition of the following formulation by a conventional technique.

| Rubber composition (Core) | Parts by weight |
|---|---|
| Cis-1,4-polybutadiene rubber (BR01 by Nippon Synthetic Rubber K.K.) | 100 |
| Zinc acrylate | 33.5 |
| Zinc oxide | 10 |
| Barium sulfate | 9.6 |
| Antioxidant | 0.2 |
| Dicumyl peroxide | 0.9 |

Next, a cover stock of the formulation shown in Table 4 was injection molded over the solid core to form a cover, which was surface treated and coated with a clear lacquer. Two-piece solid golf balls were obtained in this way. The golf balls had a cover gage of 2.0 mm, a ball diameter of 42.7 mm, and a ball weight of 45.2 grams.

The resulting golf balls were examined by the following tests.

(1) Hardness

Hardness is expressed by a distortion (mm) of a ball under a load of 100 kg. Higher values indicate softer balls.

(2) Hitting feel

With No. 1 wood (or driver), an actual hitting test was performed by a panel of five professional golfers and five skilled amateur golfers. The criterion for evaluation is given below. The result is the rating that eight or more of the ten members marked coincidentally.

○: soft

Δ: rather hard, but good

X: hard, shocks to the grip (3) Initial velocity

An initial velocity (m/s) was measured by an initial speed meter of the same type as prescribed by USGA.

(4) Hitting durability index

A ball was struck against a thick metal plate at a speed of 70 m/s until the ball was broken. The number of strikes at rupture is expressed as an index provided that the number of strikes for Comparative Example 1 is 100.

(5) Scuff resistance upon iron shots

Three pitching wedges were mounted on a swing robot machine. The ball was hit at three positions, once at one position, by each pitching wedge at a head speed of 37 m/s. The three hit areas were visually observed. Evaluation was made according to the following criterion.

○: very slight club face dent, almost negligible

Δ: definite club face dent, but no fluff from the cover surface

X: scraped surface with perceivable fluff

The results are shown in Table 4.

TABLE 4

| | Trade name | Neutralizing metal | E1 | E2 | E3 | E4 | E5 | CE1 | CE2 | CE3 | CE4 | CE5 | CE6 |
|---|---|---|---|---|---|---|---|---|---|---|---|---|---|
| Composition (pbw) | HAM7311 | Mg | 20 | 50 | 30 | 20 | 10 | 100 | | | | | |
| | S8120 | Na | 80 | | | | | | 50 | 80 | | | |
| | S8320 | Na | | 50 | 70 | 80 | 90 | | | | 50 | | |
| | S9320 | Zn | | | | | | | | | | 50 | 80 |
| | H1706 | Zn | | | | | | | 50 | 20 | 50 | | |
| | H1605 | Na | | | | | | | | | | 50 | 20 |
| | Titanium dioxide | | 5 | 5 | 5 | 5 | 5 | 5 | 5 | 5 | 5 | 5 | 5 |
| | Dispersing aid | | 0.4 | 0.4 | 0.4 | 0.4 | 0.4 | 0.4 | 0.4 | 0.4 | 0.4 | 0.4 | 0.4 |
| Ball | Hardness (mm) | | 2.69 | 2.65 | 2.79 | 2.83 | 2.90 | 2.39 | 2.67 | 2.79 | 2.75 | 2.73 | 2.82 |

TABLE 4-continued

| | Trade name | Neutralizing metal | E1 | E2 | E3 | E4 | E5 | CE1 | CE2 | CE3 | CE4 | CE5 | CE6 |
|---|---|---|---|---|---|---|---|---|---|---|---|---|---|
| properties | Hitting feel | | O | O | O | O | O | X | O | O | O | O | O |
| | Initial velocity (m/s) | | 77.08 | 77.10 | 76.99 | 76.92 | 76.85 | 77.60 | 77.10 | 76.89 | 77.01 | 77.07 | 76.80 |
| | Durability index | | 140 | 135 | 145 | 150 | 155 | 100 | 125 | 140 | 130 | 130 | 145 |
| | Scuff resistance | | O | O | O | O | O | X | X | X | X | X | X |
| Cover properties | Shore C hardness | | 76 | 77 | 73 | 70 | 67 | 90 | 80 | 73 | 77 | 77 | 70 |

As is evident from Table 4, golf balls according to the invention have an apparently high initial velocity, pleasant hitting feel, improved hitting durability, and improved scuff resistance upon iron shots, as compared with balls having equivalent hardness.

Japanese Patent Application No. 240801/1995 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball comprising a core and a cover, said cover mainly composed of a resin consisting of a first ionomer in the form of a sodium neutralized ethylene/methacrylic acid/acrylate terpolymer having a flexural modulus of 1,000 to 15,000 psi and a second ionomer in the form of a magnesium neutralized ethylene/methacrylic acid copolymer having a flexural modulus of 20,000 to 48,000 psi, said cover having a Shore C hardness of 65 to 77.

2. The golf ball of claim 1 wherein said resin consists of 20 to 90% by weight of the first ionomer and 80 to 10% by weight of the second ionomer.

3. The golf ball of claim 1, wherein the acrylate of said terpolymer comprises an ester having about 4 to about 12 carbon atoms.

4. The golf ball of claim 1, wherein the acrylate of said terpolymer is selected from methyl acrylate, ethyl acrylate, isobutyl acrylate, n-butyl acrylate, or 2-ethylhexyl acrylate.

5. The golf ball of claim 1, wherein the acrylate of said terpolymer is isobutyl acrylate.

6. The golf ball of claim 1, wherein the amount of methacrylic acid of said terpolymer is 5 to 15% by weight based on the overall weight of said first ionomer.

7. The golf ball of claim 1, wherein the amount of acrylate of said terpolymer is 5 to 45% by weight based on the overall weight of said first ionomer.

8. The golf ball of claim 1, wherein the degree of neutralization of said sodium neutralized ethylene/methacrylic acid/acrylate terpolymer is 10 to 90 mol %.

9. The golf ball of claim 1, wherein the degree of neutralization of said sodium neutralized ethylene/methacrylic acid/acrylate terpolymer is 30 to 80 mol %.

10. The golf ball of claim 1, wherein said first ionomer resin has a flexural rigidity of 10 to 100 Mpa.

11. The golf ball of claim 1, wherein said first ionomer resin has a flexural rigidity of 20 to 90 MPa.

12. The golf ball of claim 1, wherein said cover has a Shore C hardness of 67 to 73.

13. The golf ball of claim 1, the amount of methacrylic acid of said copolymer is 10 to 20% by weight, based on the overall weight of said second ionomer.

14. The golf ball of claim 1, wherein the degree of neutralization of said magnesium neutralized ethylene/methacrylic acid copolymer is 10 to 70 mol %.

15. The golf ball of claim 1, wherein the degree of neutralization of said magnesium neutralized ethylene/methacrylic acid copolymer is 15 to 60 mol %.

16. The golf ball of claim 1, wherein said second ionomer resin has a flexural rigidity of 200 to 300 Mpa.

17. The golf ball of claim 1, wherein said cover consists essentially of 30 to 70% by weight of the first ionomer and 70 to 30% by weight of the second ionomer.

18. The golf ball of claim 1, wherein said second ionomer resin has a flexural modulus of 30,000 to 45,000 psi.

* * * * *